United States Patent [19]

Maier

[11] Patent Number: 4,907,663

[45] Date of Patent: Mar. 13, 1990

[54] DRILLING TOOL

[75] Inventor: Elmar Maier, Feldkirch-Tisis, Austria

[73] Assignee: Hilti Aktiengesellschaft, Fürstentum, Liechtenstein

[21] Appl. No.: 246,369

[22] Filed: Sep. 19, 1988

[30] Foreign Application Priority Data

Sep. 19, 1987 [DE] Fed. Rep. of Germany ..... 3731630

[51] Int. Cl.[4] ..... E21B 10/02

[52] U.S. Cl. ..... 175/330; 279/93; 285/307; 285/319; 285/921; 403/106; 403/329; 408/145

[58] Field of Search ..... 175/321, 330, 403; 285/307, 319, 921; 403/106, 109, 329, 377; 408/145; 279/93

[56] References Cited

U.S. PATENT DOCUMENTS

| | | | |
|---|---|---|---|
| 1,727,563 | 9/1929 | Ross | 175/403 X |
| 2,419,901 | 4/1947 | Lake | 175/330 |
| 3,131,766 | 5/1964 | Chancellor et al. | 285/307 X |
| 3,773,360 | 11/1973 | Timbers | 285/307 |

*Primary Examiner*—William P. Neuder
*Attorney, Agent, or Firm*—Toren, McGeady & Associates

[57] ABSTRACT

A drilling tool is made up of a holder and a drilling member detachably connected together. One of the holder and the drilling member telescopes into the other. Resilient tab-like parts on one of the holder and the drill member engages within recesses in the other for effecting a rotatably locked connection between them. Accordingly, torque can be transmitted through the drilling tool by the tab-like parts and the recesses for effecting a drilling operation. The holder and drilling member can be disconnected without the use of any auxiliary tools.

6 Claims, 1 Drawing Sheet

DRILLING TOOL

BACKGROUND OF THE INVENTION

The present invention is directed to a drilling tool made up of an axially extending hollow cylindrically-shaped holder and a core drill bit. The holder and the drill bit are detachably connected together with one of them telescoping into the other. Projections are provided on one of the holder and the drill bit and engage into recesses on the other for providing a rotatably locked connection.

For reasons of economy, it is known in drilling tools to arrange the core drill bit, incorporating diamond grains, on a holder so that the bit can be detached for purposes of replacement, since the drill bit is exposed to heavy wear. Accordingly, screw connections are used, however, they have the disadvantage that to detach the tool bit, a considerable force is required involving the use of auxiliary tools.

Such a drilling tool is disclosed in DE-A1-32 40 263 and includes a hollow cylindrically-shaped holder and a core drill bit detachably mounted on the holder. Projections in adjoining regions of the holder and the core drill bit connect the bit to the holder so that the holder and bit can be rotated as a unit. A clamping ring, inserted externally in a groove extending circumferentially in the region of the projections, is provided for the axial connection of the holder and the drill bit. A considerable problem with this known drilling tool involves the removal of the clamping ring for replacing the drill bit. In the use of the drilling tool, drilled material can become fixed in the base of the groove, so that the clamping ring does not adequately seat within the groove. During operation, this problem can cause the automatic disengagement of the clamping ring. Another disadvantage involves the impaired stability of the adjoining regions of the part containing the projections.

SUMMARY OF THE INVENTION

Therefore, the primary object of the present invention is to provide a drilling tool with a replaceable core drill bit, and the drilling tool, in addition to a simple construction and high stability, is distinguished by an effective rotatable connection of the holder and the drill bit and the easy replaceability of the drill bit.

In accordance with the present invention, the projections are formed in one part of the drilling tool as resilient springlike plates with the free end of the plates facing in the circumferential direction extending parallel to the axis of the holder and engaging an abutment in the recess of the other part for effecting rotational drive of the drill bit. The arrangement of the holder and the drill bit in accordance with the present invention affords an easily detachable connection between the two parts of the tool. The ends of the projection facing in the rotatable direction of the drilling tool enable the transmission of large torques or turning moments in the circumferential direction, that is, in the operating rotational direction of the drilling tool.

The resilient plates fit into cooperating recesses in the telescoping regions of the holder and the core drill bit. The free ends of the projections forms shoulders facing in the rotational direction so that torque can be transmitted to counter-shoulders or abutments in the operating rotational direction. Accordingly, the rotational movement required for the operation of the drilling tool can be transmitted from the mechanically driven holder to the core drill bit. The detachment of the drill bit from the holder can be effected by rotating the drill bit for separating the drive shoulders from the counter-shoulders, that is, by turning the drill bit in the direction opposite to the operating rotational direction.

Two or more plates and recesses or openings, respectively, are provided around the circumferences of the holder and the drill bit at a uniform angular distance apart. The projections or plates and the recesses or openings are preferably located in corresponding axially extending regions of the drilling tool parts, so that with the uniform spacing it is possible to interconnect the parts in a plurality of rotational positions.

Preferably, the projections or plates are formed as resiliently articulated plate-like wall parts of one of the holder and the drill bit. Such a construction affords a simple arrangement whereby the force required to interconnect the plates in the recesses is provided by the inherent resilience of the plates. As a result, separate articulated joints and spring means are not required. For the sake of simplicity, the plate-like parts can be formed by punching out a portion of the wall of the part in which the plates are formed.

One part of the drilling tool telescopes into the other and the resilient plate-like wall part project inwardly or outwardly. By providing a telescoping overlapping of the parts, it is possible to insure an exact centric alignment and to secure the parts relative to one another. The resilient plate-like wall parts extend circumferentially and project in a gradual manner from the cylindrical contour of the drilling tool part in which they are formed. With the telescoping arrangement of the parts, the plate-like wall parts are depressed opposite to the direction of their inherent resilience when the parts are telescoped together so that the parts automatically interengage when the plate-like parts move into the recesses or opening in the other part of the drilling tool.

In a preferred embodiment of the present invention, one part of the drilling tool is positionable within the other in a telescoping manner and the resilient plate-like wall parts project into the hollow interior of the part. As a result, the plate-like wall parts are protected to a considerable extent from any external damage and, as a result, maintain their functioning capability for a long period of time.

In another preferred feature of the invention, the resilient plate-like wall parts are formed in the hollow cylindrically-shaped holder. This feature contributes to the protection of the wall plates. The holder which is engaged within the housing of a driving member, is less exposed to damage than the core drill bit because of its engagement with the housing, while the core drill bit is usually placed in a loose state with other working tools in a tool box. Moreover, the arrangement of the plate-like wall parts in the holder and particularly since they project into the interior of the holder, the wall parts are protected during operation because they are spaced from the surface of the borehole being formed. Accordingly, the plate-like wall parts are protected from wear due to engagement with the surface of the borehole.

To increase the stability of the drilling tool part containing the recesses or openings, the openings are preferably closed in the axial direction. In a desirable arrangement, the portion of the part containing the recesses is closed in the direction in which it is in telescoping relation with the other part. Further, the recesses are closed in the axial direction to contribute to improved axial engagement between the holder and the core drill bit so that there is a closed counter shoulder for the free ends of the plate-like wall part facing in the rotational drilling direction.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings:

FIG. 3 is an axially extending section of a core drill bit;

DETAILED DESCRIPTION OF THE INVENTION

Figure 1:
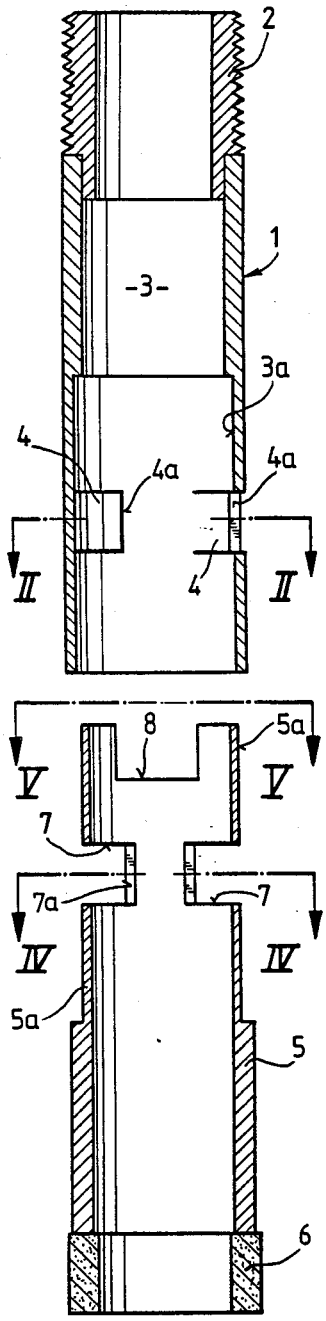
FIG. 1 is an axially extending sectional view of a holder of a drilling tool embodying the present invention.

In FIG. 1, a holder 1 forming a part of a drilling tool is disclosed and the holder is an axially extending hollow cylindrically shaped member with a threaded connection piece 12 at one end intended to connect the holder to a drive member. The holder has a first end at its lower end in FIG. 1, and a second end at its upper end, that is, the end with the threaded connection piece 2. The first end of the holder faces in the drilling direction of the drilling tool. A central bore is located within the holder 1 extending between the first and second ends with a portion 3*a* extending from the first end toward the second end having a larger diameter than the portion of the bore extending to the connection piece 2, which has a smaller inside diameter than the bore 3.

Figure 2:
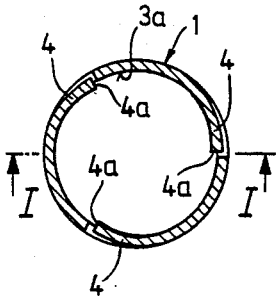
FIG. 2 is a sectional view taken along the line II—II in FIG. 1.

In the portion 3*a* of the holder 3, plate-like wall parts 4 are resiliently articulated to the holder and are uniformly spaced in the circumferential direction. The wall parts 4 are located in the same axial range. As displayed in FIG. 2, the wall parts 4 extend substantially in the circumferential direction of the holder and project inwardly into the interior of the holder defined by the bore 3. In a preferred arrangement, wall parts are punched inwardly from the wall of the holder 1, so that they project gradually inwardly in the circumferential direction toward the axially extending free ends 4*a* of the wall parts 4. The free ends 4*a* face in the circumferential direction, that is the direction in which the drilling tool is rotated by a drive motor for effecting the drilling operation and the free ends form axially extending drive shoulders.

Core drill bit 5 is also a hollow axially extending cylindrically shaped member having a first or lower end as viewed in FIG. 3 and a second or upper end. The first end is the leading end in the drilling direction. At its first end, the drill bit 5 has a cutting ring 6 containing diamond grains. Drill bit 5 has an axially extending portion 5*a* extending from its second end, that is, the end spaced from the cutting ring 6, and the outer diameter of the portion 5*a* is stepped inwardly from the diameter of the portion of the holder extending from its first end. As a result of the inwardly stepped outer diameter of the portion 5*a*, a shoulder is formed on the outside surface of the drill bit facing toward the second end of the bit. In the portion 5*a* of the holder, spaced axially between the second end and the shoulder, there are three recesses or openings 7 spaced uniformly apart in the circumferential direction with the openings all located in the same axial range of the portion 5*a* and having the same axial height corresponding substantially to the axial height or dimension of the wall parts 4. One of the axially extending edges of the openings 7 serves as a counter-shoulder or abutment 7*a* for the free end 4*a* of the plates 4. In other words, in the operation of the drilling tool, the free ends 4*a* each contact a corresponding shoulder or abutment 7*a* in the openings.

Figure 5:
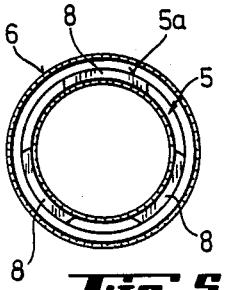
FIG. 5 is an end view of the core drill bit in FIG. 3, taken in the direction of the arrows V—V.
Figure 4:
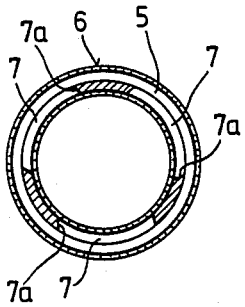
FIG. 4 is a sectional view taken along the line IV—IV in FIG. 3.

At the second end of the core drill bit 5, three rectangularly-shaped notches 8 are provided, each open at the second end, that is being open in the direction opposite to the and are offset in the circumferential direction relative to the openings 7 to facilitate the interconnection of the core drill bit 5 into the holder 1. Initially, as the core drill bit 5 is inserted into the first end of the holder 1, the notches 8 are aligned with the wall parts 4 so that the second end of the drill bit can pass the wall parts 4. By moving the drill bit further into the holder and rotating it, the plates are forced radially outward by the outer surface of the inwardly stepped portion 5*a* so that the openings 7 arrive within the same axial range as the wall parts 4. By rotating the drill bit 60° relative to the holder 1, the plate-like wall parts move into the openings 7 with the free ends 4*a* contacting the abutments 7*a* in the openings. The plates which are moved radially outwardly as the second end portion of the drill bit is inserted into the first end portion of the holder when the wall parts 4 and the openings 7 are in alignment, the wall parts rebound inwardly into the opening affording an effective automatic locking of the drill bit to the holder. In FIGS. 4 and 5, the offset relation of the openings 7 with the notches 8 in the circumferential direction is illustrated.

Figure 6:
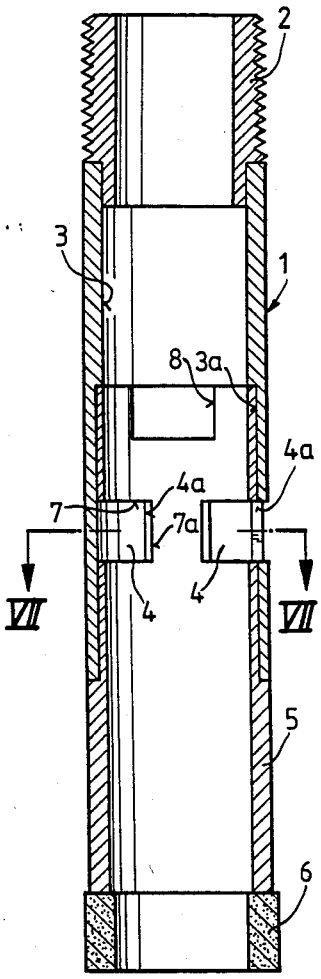
FIG. 6 is an axially extending sectional view of the assembly of the drilling tool including the parts shown in FIG. 1 and FIG. 3 and taken along the line VI—VI in FIG. 7.
Figure 7:
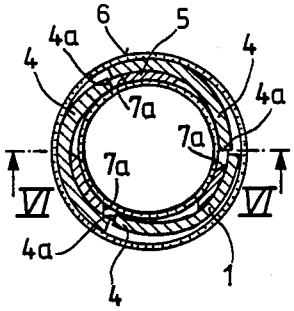
FIG. 7 is a sectional view taken along the line VII—VII in FIG. 6.

As shown in FIGS. 6 and 7, the holder 1 and the drill bit 5 of the drilling tool are in positively locking engagement with the plate-like wall parts 4 seated within the openings 7. When the holder 1 is driven in the rotational direction for drilling a borehole, the free ends 4*a* of the wall parts 4 contact the counter-abutments 7*a* and a reliable rotational drive for effecting drilling is assured.

For disassembling the drilling tool, the core drill bit 5 is rotated opposite to the rotational drilling direction by approximately 60° and the plate-like wall parts 4 are moved out of the openings 7 by the outer surface of the axially extending portion 5*a* of the drill bit. With the wall parts 4 disengaged from the openings 7, the drill bit 5 can be moved in the axial direction out of the holder 1.

While specific embodiments of the invention have been shown and described in detail to illustrate the application of the inventive principles, it will be understood that the invention may be embodied otherwise without departing from such principles.

I claim:

1. Drilling tool comprising a hollow axially extending cylindrically shaped holder having a first end and a second end and spaced apart in the axial direction, a hollow axially extending cylindrically shaped drilling member having a first end and a second end spaced apart in the axial direction, said drilling member being detachably connected to said holder and one of said holder and drilling member being telescopically engageable within the other, means on one of said holder and drilling member for engagement with receiving means in the other one of said holder and drilling member, wherein the improvement comprises that said means comprises circumferentially and axially extending plate-like wall parts having a first axially extending end connected to the one of said holder and drilling member and a second axially extending free end spaced circumferentially from the first end, and said receiving means comprising recesses in the other one of said holder and drilling member arranged to receive said wall parts and each said recess having an axially extending abutment arranged to be contacted by the second free end of one of said wall parts, said wall parts are resiliently articulated to the one of said holder and drilling member, said free end being radially displaceable relative to the one of said holder and drilling member to which said first end is connected for engagement within one of said recesses, the free ends of said resilient wall parts project from the one of said holder and drilling member transversely of the axial direction, the one of said holder and drilling member containing said wall parts receive the other one of said holder and drilling member therein in a telescoping manner and the free second ends of said wall parts project inwardly from the one of said holder and drilling member, said resilient wall parts are formed as a part of said holder, said recesses are openings formed in said drilling member with said openings being closed on opposite sides extending transversely of the axial direction.

2. Drilling tool, as set forth in claim 1, wherein said wall parts and said openings have approximately the same dimensions in the axial and circumferential directions so that said wall parts fit closely into said openings.

3. Drilling tool, as set forth in claim 1, wherein tee second end of said drilling member has notches therein extending axially inwardly from the second end with said notches dimensioned in the axial and circumferential directions for receiving a corresponding one of said wall parts when said drilling bit is telescopically inserted into the first end of said holder.

4. Drilling tool, as set forth in claim 3, wherein said drilling member has a cutting part containing diamond grains at the first end of said drilling bit.

5. Drilling tool, as set forth in claim 3, wherein said holder has an inside diameter extending from the second end smaller than the inside diameter extending from the first end, and said drilling bit has an outside diameter extending from the second end thereof smaller than the inside diameter of said holder extending from the first end thereof and the smaller diameter of the outside of said drilling bit being arranged to fit within the larger inside diameter at the first end of said holder.

6. Drilling tool, as set forth in claim 3, wherein said holder has an axially extending threaded connection section at the second end thereof for connection to a drive source for the drilling tool.

* * * * *